US008936226B2

(12) United States Patent
Chang

(10) Patent No.: US 8,936,226 B2
(45) Date of Patent: Jan. 20, 2015

(54) SUPPORT FRAME FOR A MODULAR LECTERN

(71) Applicant: Chuan-Ching Chang, Tainan (TW)

(72) Inventor: Chuan-Ching Chang, Tainan (TW)

( * ) Notice: Subject to any disclaimer, the term of this patent is extended or adjusted under 35 U.S.C. 154(b) by 210 days.

(21) Appl. No.: 13/665,998

(22) Filed: Nov. 1, 2012

(65) Prior Publication Data

US 2014/0117194 A1 May 1, 2014

(51) Int. Cl.
*A47B 19/08* (2006.01)
*A47B 19/00* (2006.01)

(52) U.S. Cl.
CPC ..... *A47B 19/00* (2013.01)
USPC ..... 248/460; 248/165; 108/18; 108/56.3; 108/155; 312/265.5

(58) Field of Classification Search
CPC ..... A47B 3/02; A47B 3/10; A47B 19/08; A47B 23/044; A47B 23/046
USPC ..... 248/174, 447, 459, 460, 461, 462, 463, 248/464, 465, 450, 165; 108/18, 56.3, 119, 108/123, 124, 155, 159.12, 160; 312/140.2, 312/258, 265.5
See application file for complete search history.

(56) References Cited

U.S. PATENT DOCUMENTS

| | | | | | |
|---|---|---|---|---|---|
| 100,430 | A * | 3/1870 | Mallory | 108/119 |
| 113,266 | A * | 4/1871 | Crane | 108/118 |
| 733,100 | A * | 7/1903 | Werner | 248/456 |
| 1,670,145 | A * | 5/1928 | Farrington | 108/4 |
| 1,800,685 | A * | 4/1931 | Griffis | 108/159.11 |
| 2,000,915 | A * | 5/1935 | Blake | 108/159 |
| 2,265,105 | A * | 12/1941 | Farrington | 108/4 |
| 2,449,492 | A * | 9/1948 | Long | 248/454 |
| 3,211,412 | A * | 10/1965 | Nichols | 248/465 |
| 4,322,109 | A * | 3/1982 | Thebaud | 297/25 |
| D265,025 | S * | 6/1982 | Nichols et al. | D6/353 |
| 4,848,243 | A * | 7/1989 | Giordano | 108/9 |
| 5,078,056 | A * | 1/1992 | McCauley | 108/115 |
| 6,196,560 | B1 * | 3/2001 | Ohlsson | 280/30 |
| D449,470 | S * | 10/2001 | Morrow | D6/484 |
| 6,488,252 | B1 * | 12/2002 | Ibrahim | 248/460 |
| 6,749,189 | B1 * | 6/2004 | Wolff et al. | 269/139 |
| 7,364,129 | B1 * | 4/2008 | Levari, Jr. | 248/460 |
| 7,588,255 | B2 * | 9/2009 | Katz | 280/47.27 |
| 8,267,477 | B1 * | 9/2012 | Appiah Finn | 297/423.41 |
| 8,567,740 | B2 * | 10/2013 | Tarnutzer et al. | 248/456 |
| 8,740,207 | B2 * | 6/2014 | Lawrence et al. | 269/139 |
| 2007/0221811 | A1 * | 9/2007 | Hauser et al. | 248/454 |
| 2009/0289166 | A1 * | 11/2009 | Hopfer | 248/456 |
| 2010/0155346 | A1 * | 6/2010 | Cheng | 211/13.1 |

* cited by examiner

*Primary Examiner* — Terrell McKinnon
*Assistant Examiner* — Eret McNichols
(74) *Attorney, Agent, or Firm* — Patent Office of Bang Shia

(57) ABSTRACT

A support frame for a modular lectern is assembled together with a top board, a bottom board and a divider board to form the modular lectern and is provided with a main board, a first connecting member and a second connecting member, wherein the parts of the support frame of are locked together in a tongue and groove manner, and can be disassembled into the three main parts: the main board, the first connecting member and the second connecting member, which can be stacked one upon another together with the top, bottom and divider boards for easy transportation. Furthermore, the top and bottom boards are pivoted to the main board via the first and second connecting portions, so that the top and bottom boards can be folded to further save transportation space.

8 Claims, 4 Drawing Sheets

SUPPORT FRAME FOR A MODULAR LECTERN

BACKGROUND OF THE INVENTION

1. Field of the Invention

The present invention relates to a modular lectern, and more particular to a support frame for a modular lectern.

2. Description of the Prior Art

FIG. 1 shows a conventional lectern 1 which comprises a base 11, a top board 12 and a divider board 13 which are fixed together by nails or bolts. The conventional lectern 1 is large and heavy in order to have a large carrying space and bearing capacity, even two adult men would feel difficult to move the lectern 1. Furthermore, the conventional lectern 1 is not collapsible, which is convenient for transportation.

The present invention has arisen to mitigate and/or obviate the afore-described disadvantages.

SUMMARY OF THE INVENTION

The primary objective of the present invention is to provide a support frame for a modular lectern, wherein the lectern can be disassembled easily and quickly for easy transportation.

To achieve the above objective, a support frame for a modular lectern in accordance with the present invention is assembled together with a top board, a bottom board and a divider board to form the modular lectern. The top, bottom and divider boards each have a predetermined amount of thickness, and the divider board is formed with a slot. The support frame comprises a main board, a first connecting member and a second connecting member. The main board is an arc-shaped structure with an arc-shaped convex surface and an arc-shaped concave surface and inserted in the slot of the divider board. A support member which is disposed on the arc-shaped concave surface is fixed to the divider board. The main board has one end provided with a top connecting member and another end provided with a bottom connecting member. The top connecting member is provided with a top groove, and the bottom connecting member is provided with a bottom groove. The first connecting member includes a first engaging groove and a first inserting groove defining a sharp angle with respect to the first engaging groove, the first engaging groove is engaged with a top end of the divider board, the top board has one end inserted in the first inserting groove and another end inserted in the top groove of the top connecting member. The second connecting member includes a second engaging groove and a second inserting groove defining a sharp angle with respect to the second engaging groove, the second engaging groove is engaged with a bottom end of the divider board, the bottom board has one end inserted in the second inserting groove and another end inserted in the bottom groove of the bottom connecting member.

It is to be noted that the parts of the support frame of the present invention are locked together in a tongue and groove manner, and can be disassembled into the three main parts: the main board, the first connecting member and the second connecting member, which can be stacked one upon another together with the top, bottom and divider boards for easy transportation. Furthermore, the top and bottom boards are pivoted to the main board via the first and second connecting portions, so that the top and bottom boards can be folded to further save transportation space.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
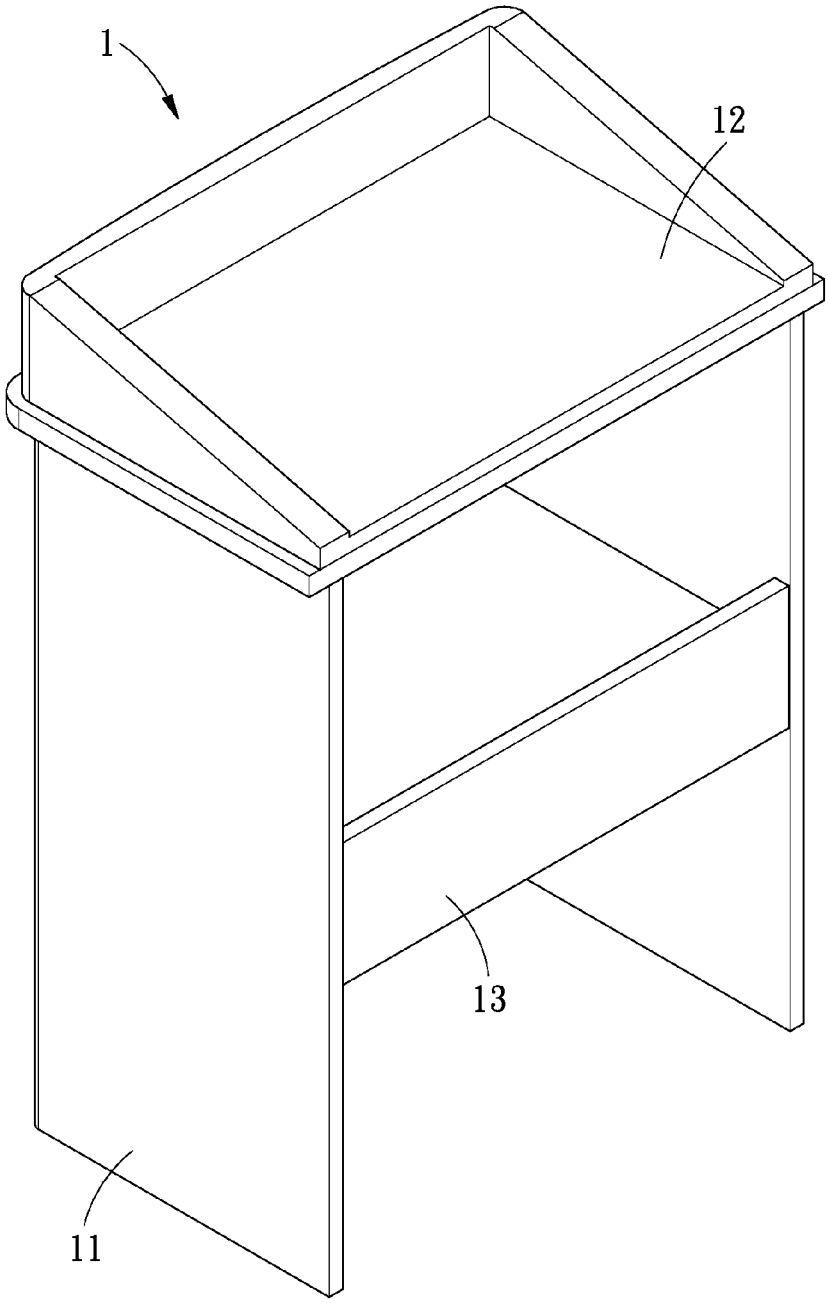
FIG. 1 PRIOR ART
FIG. 1 is a perspective view of a conventional lectern.
Figure 2:
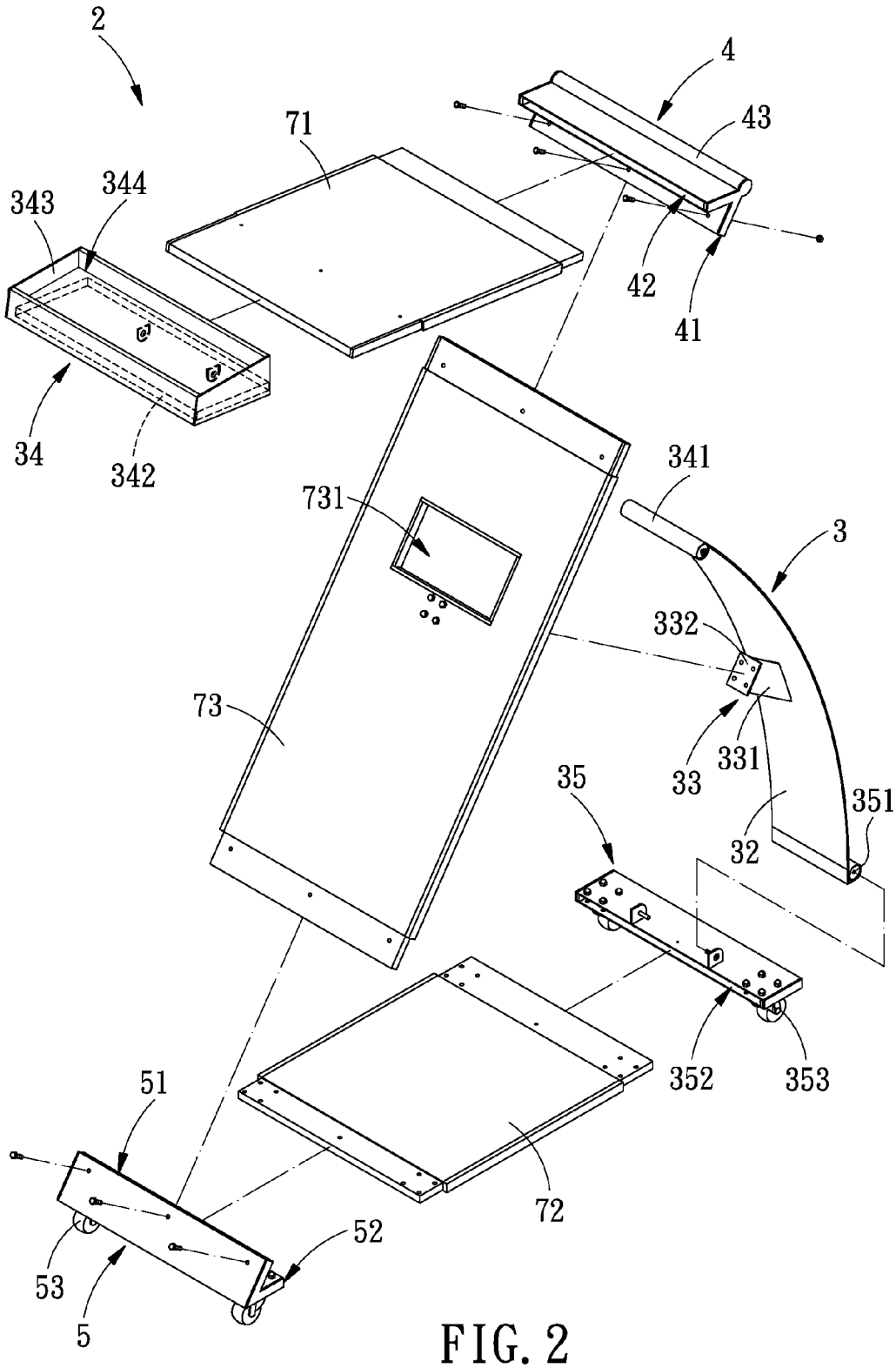
FIG. 2 is an exploded view of a modular lectern in accordance with the present invention.
Figure 3:
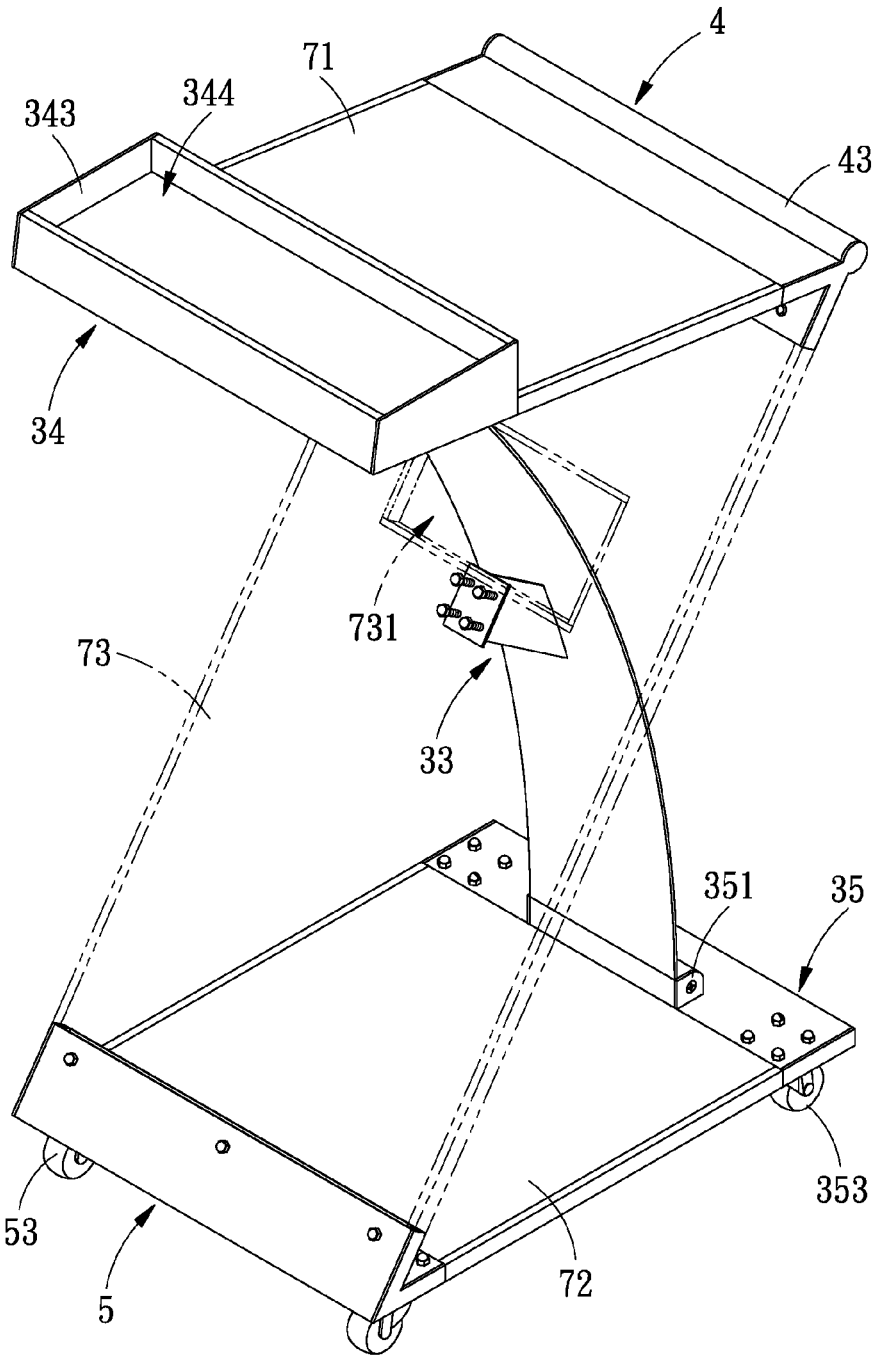
FIG. 3 is an assembly view of the modular lectern in accordance with the present invention.
Figure 4:
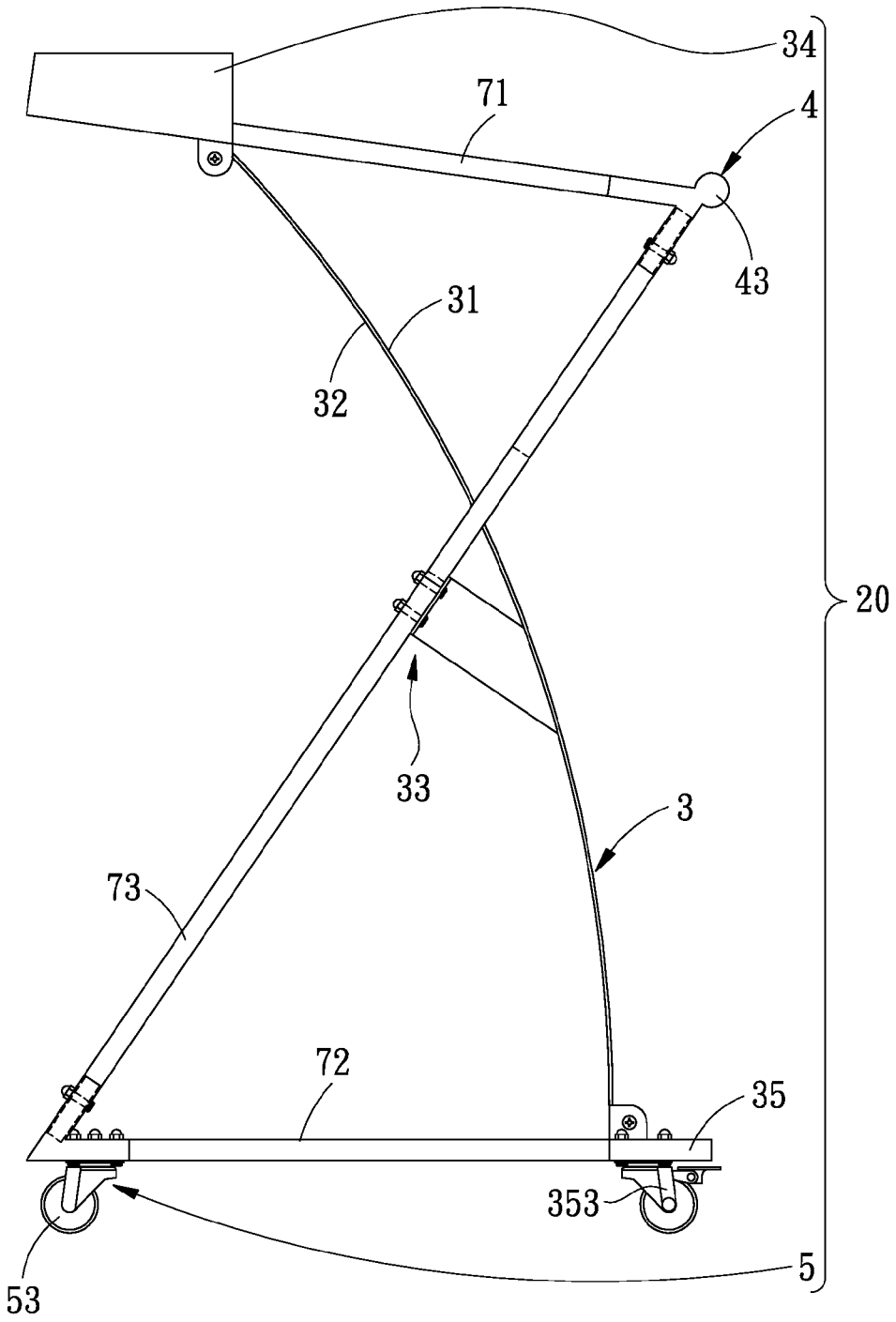
FIG. 4 is a side view of the modular lectern in accordance with the present invention.

Referring to FIGS. 2-4, a support frame 20 for a modular lectern 2 in accordance with the present invention is assembled together with a top board 71, a bottom board 72 and a divider board 73 to form the lectern 2. The top, bottom and divider boards 71, 72, 73 are rectangular boards with a predetermined amount of flexibility and thickness, and can be made of transparent or opaque materials of wood, acrylic, metal, and glass. The top, bottom and divider boards 71, 72, 73 can be printed or coated with different colors or patterns. The divider board 73 is formed with an elongated slot 731. The support frame 20 includes a main board 3, a first connecting member 4 and a second connecting member 5.

The main board 3 is arc-shaped structure with an arc-shaped convex surface 31 and an arc-shaped concave surface 32 and inserted in the slot 731 of the divider board 73. A support member 33 which is disposed on the arc-shaped concave surface 32 is fixed to the divider board 73 and includes a support rib 331 which has one end fixed to the arc-shaped concave surface 32 and another end fixed to a connecting board 332 which is fixed to the divider board 73. The main board 3 has one end provided with a top connecting member 34 which has a first connecting portion 341 pivotally connected to the arc-shaped concave surface 32. Another end of the main board 3 is provided with a bottom connecting member 35 which has a second connecting portion 351 pivotally connected to the arc-shaped convex surface 31, and on the bottom connecting member 35 is provided a plurality of rollers 353. The top connecting member 34 is provided at a surface adjacent to the arc-shaped convex surface 31 with a top groove 342. Around a periphery of a top surface of the top connecting member 34 is formed a protruding wall 343 which defines a chamber 344 on the top surface of the top connecting member 34. The bottom connecting member 35 is provided on a surface thereof adjacent to the arc-shaped concave surface 32 with a bottom groove 352.

The first connecting member 4 includes a first engaging groove 41 and a first inserting groove 42 defining a sharp angle with respect to the first engaging groove 41. The first engaging groove 41 is to be engaged with a top end of the divider board 73 so as to fix the first connecting member 4 to the divider board 73. The top board 71 has one end inserted in the first inserting groove 42 and another end inserted in the top groove 342 of the top connecting member 34. On the top of the first connecting member 4 is provided a stop rib 43.

The second connecting member 5 includes a second engaging groove 51 and a second inserting groove 52 defining a sharp angle with respect to the second engaging groove 51. The second engaging groove 51 is to be engaged with a bottom end of the divider board 73 so as to fix the second connecting member 5 to the divider board 73. The bottom board 72 has one end inserted in the second inserting groove 52 and another end inserted in the bottom groove 352 of the bottom connecting member 35. The second connecting member 5 is provided with a plurality of rollers 53.

The first connecting member 4 and the top board 71, the first connecting member 4 and the divider board 73, the second connecting member 5 and the divider board 73, the second connecting member 5 and the bottom board 72, and the bottom connecting member 35 and the bottom board 72 are fixed to each other by bolts.

When in assembly, the main board 3 is inserted into the slot 731 of the divider board 73, the support member 33 is then fixed to the divider board 73, and then the bottom board 72, the second connecting member 5, the top board 71 and the first connecting member 4 are assembled in sequential order. The first connecting member 4 and the top board 71, the first connecting member 4 and the divider board 73, the second connecting member 5 and the divider board 73, the second connecting member 5 and the bottom board 72, and the bottom connecting member 35 and the bottom board 72 are fixed to each other by bolts, so as to improve the stability of the modular lectern 2 of the present invention.

It is to be noted that the parts of the support frame 20 of the present invention are locked together in a tongue and groove manner, and can be disassembled into the three main parts: the main board 3, the first connecting member 4 and the second connecting member 5, which can be stacked one upon another together with the top, bottom and divider boards 71, 72, 73 for easy transportation. Furthermore, the top and bottom connecting members 34, 35 are pivoted to the main board 3 via the first and second connecting portions 341 and 351, so that the first and second connecting portions 341 and 351 can be folded to further save transportation space.

In addition to the fact that the support frame 20 can be assembled and disassembled for easy transportation, it can also be used in combination with different top, bottom and divider boards 71, 72, 73 which are made of different materials or have different shapes. For example, the top and divider boards 71, 73 are replaceable, so that different top and divider boards 71, 73 of different shapes can be used to make the lectern look new and fresh. Or, a divider board 73 made of transparent material can be used so as not to block the audience's view, or the bottom board can be replaced with a steel bottom board 72 in order to add weight to the lectern of the present invention, making it more stable. Besides, when any parts of a conventional lectern are broken, the lectern as a whole must be replaced. However, if any part of the lectern in accordance with the present invention is broken, only the broken part, instead of the whole lectern, needs to be replaced.

Referring then to FIGS. 3 and 4, the top board 71, the top connecting member 34 and the first connecting member 4 are coupled together to form an inclined surface, and a lower end of the inclined surface is located on the lecture's side, which fits the lecturer's usage habits better. Furthermore, on the top of the first connecting member 4 is provided the stop rib 43, which prevents the teaching tools that the lecturer or teacher puts on the top board 71 from falling off. The chamber 344 on the top of the top connecting member 34 is provided for holding objects, and the protruding wall 343 around the chamber 344 prevents the articles from falling off.

It is to be noted that, as shown in FIGS. 3 and 4, the divider board 73 and the main board 3 intersect in the middle, and the main board 3 is arc-shaped structure, the support member 33 on the arc-shaped concave surface 32 is fixed to the divider board 73, by such arrangements, the forces applied to the top board 71, the top connecting member 34 and the first connecting member 4 can be averagely transferred to the bottom connecting member 35, the second connecting member 5 and the bottom board 72, so as to improve the structural strength and bearing capacity of the lectern of the present invention.

While we have shown and described various embodiments in accordance with the present invention, it is clear to those skilled in the art that further embodiments may be made without departing from the scope of the present invention.

What is claimed is:

1. A support frame for a modular lectern being assembled together with a top board, a bottom board and a divider board to form the modular lectern, the top, bottom and divider boards each having a predetermined amount of thickness, the divider board being formed with a slot, the support frame comprising:

a main board being an arc-shaped structure with an arc-shaped convex surface and an arc-shaped concave surface and inserted in the slot of the divider board, a support member being disposed on the arc-shaped concave surface and fixed to the divider board, the main board having one end provided with a top connecting member and another end provided with a bottom connecting member, the top connecting member being provided with a top groove, the bottom connecting member being provided with a bottom groove;

a first connecting member including a first engaging groove and a first inserting groove defining a sharp angle with respect to the first engaging groove, the first engaging groove being engaged with a top end of the divider board, the top board having one end inserted in the first inserting groove and another end inserted in the top groove of the top connecting member, a stop rib being formed on the top of the first connecting member; and a second connecting member including a second engaging groove and a second inserting groove defining a sharp angle with respect to the second engaging groove, the second engaging groove being engaged with a bottom end of the divider board, the bottom board having one end inserted in the second inserting groove and another end inserted in the bottom groove of the bottom connecting member.

2. The support frame for the modular lectern as claimed in claim 1, wherein the top connecting member has a first connecting portion pivotally connected to the arc-shaped concave surface.

3. The support frame for the modular lectern as claimed in claim 1, wherein the top connecting member has a first connecting portion pivotally connected to the main board.

4. The support frame for the modular lectern as claimed in claim 1, wherein the bottom connecting member has a second connecting portion pivotally connected to the arc-shaped convex surface.

5. The support frame for the modular lectern as claimed in claim 1, wherein the bottom connecting member has a second connecting portion pivotally connected to the main board.

6. The support frame for the modular lectern as claimed in claim 1, wherein the first connecting member and the top board, the first connecting member and the divider board, the second connecting member and the divider board, the second connecting member and the bottom board, and the bottom connecting member and the bottom board are fixed to each other by bolts.

7. The support frame for the modular lectern as claimed in claim 1, wherein a protruding wall is formed around a periphery of a top surface of the top connecting member to define a chamber on the top surface of the top connecting member.

8. The support frame for the modular lectern as claimed in claim 1, wherein the second connecting member is provided with a plurality of rollers.

* * * * *